US005610348A

United States Patent [19]

Aladin et al.

[11] Patent Number: 5,610,348

[45] Date of Patent: Mar. 11, 1997

[54] CONSTRUCTION OF THE DISCANT STRINGS FOR THE CLASSIC AND THE FLAMENCO GUITAR

[76] Inventors: Alexander Aladin; Irina M. Aladina, both of Niemetalstrasse 2, D-3402 Dransfeld-Löwenhagen; Bernd Schmidt, Am Steimel 16, D-3430 Witzenhausen, all of Germany

[21] Appl. No.: 854,492

[22] Filed: Mar. 20, 1992

[30] Foreign Application Priority Data

Mar. 21, 1991 [DE] Germany ..... 41 09 334.8

[51] Int. Cl.[6] ..... G10D 3/00

[52] U.S. Cl. ..... 84/297 S; 84/199

[58] Field of Search ..... 84/297 S, 199

[56] References Cited

U.S. PATENT DOCUMENTS

| | | | |
|---|---|---|---|
| 2,762,251 | 9/1956 | Infeld | 84/297 S |
| 3,120,144 | 2/1964 | Bayer | 84/297 S |
| 3,610,084 | 10/1971 | Behringer | 84/297 S |
| 3,826,171 | 7/1974 | Kaar | 84/297 S |
| 4,365,534 | 12/1982 | Rendell | 84/297 S |

FOREIGN PATENT DOCUMENTS

| | | |
|---|---|---|
| 169306 | 11/1951 | Austria . |
| 173216 | 11/1952 | Austria . |

OTHER PUBLICATIONS

"Principles of Materials Science and Engineering", William Smith, 1986, p. 603.

*Primary Examiner*—Cassandra C. Spyrou
*Attorney, Agent, or Firm*—Bucknam and Archer

[57] ABSTRACT

There is provided a discant string construction for classic and flamenco guitars having a polyfilament core formed of a group of non-twisted with respect to each other synthetic filaments, a first covering layer of metal wire spirally wound in tight contact coils, and a second covering layer of plastic material covering the first layer.

9 Claims, 4 Drawing Sheets

CONSTRUCTION OF THE DISCANT STRINGS FOR THE CLASSIC AND THE FLAMENCO GUITAR

The present invention relates to the construction of the first three discant strings 1-E, 2-H and 3-G for classic and flamenco guitars.

A full set of strings for both the classic and flamenco guitar consists of six strings, which are divided into bass strings 4, 5 and 6 and discant strings 1, 2 and 3. Bass strings differ from discant strings in their force, duration of sound and timbre. These sound distinctions are a result of the composition of the strings and the material used in their construction.

The bass strings are composed of a polyfilament core and a single metal covering layer consisting of a metal wire. Discant strings are almost exclusively formed of a single nylon filament. These first three strings have also been formed from a polyfilament core and a single plastic covering layer. However, the sound and playing quality of discant strings formed of a plastic covered polyfilament core are not as good as those formed of a single nylon filament, and so they are rarely used in practice.

The differences in composition and the different kinds of materials used determine the unbalanced sound quality between bass and discant strings. The sound quality of unitary nylon discant strings such as force and duration of sound is not as powerful as those of bass strings consisting of a polyfilament core and a metal wire covering. In order to balance the sound of bass and discant strings to the maximum, the first three discant strings must be constructed in the same way as the bass strings, i.e. to have a polyfilament core and a metal covering layer.

In order to make the mass of the discant strings correspond to their tuning, it is necessary to use a very thin metal cover over the polyfilament core. However, discant strings formed with such a thin metal layer have two essential disadvantages. First, their sound compared to that of the bass strings, has a sharp metallic tone which is as unsatisfactory as the soft tone of unitary nylon discant strings. Secondly, the thin covering metal layer is quickly worn away which makes it impossible to use them.

It is, therefore, a primary object of the present invention to provide a discant string construction which eliminates the sharp metallic tone to the required degree so as to provide a good sound for the discant strings which is comparable to that of the bass strings and has the same timbre and which also protects the thin metal layer from damage.

The above object, as well as others which will hereinafter become apparent, is accomplished in accordance with the present invention by providing a discant string for classic and flamenco guitars having a polyfilament core formed of a group of non-twisted with respect to each other synthetic filaments, a first covering layer of metal wire spirally wound in tight contact coils and formed of copper, zinc, brass or bronze covering said polyfilament core, and a second covering layer of plastic material covering said first layer.

In addition, the discant strings according to the construction of the present invention have high tension and are small in diameter. The enhanced tension, compared to the unitary nylon strings, makes it possible to position the strings 1–2 mm closer to the metal fret of a finger-board of a guitar, and this considerably facilitates the left hand technique. For right hand technique, the enhanced tension has an effect of pushing back the fingers and decreasing the time of contact of the fingers with the strings resulting in increasing the speed of right hand fingering.

The powerful and enhanced continuance sound, depth and clear tone, timbre with a large scale of high overtones, small diameter and enhanced tension, are qualities of the discant strings according to the present invention which enable one to achieve the best results in playing technique and performance.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
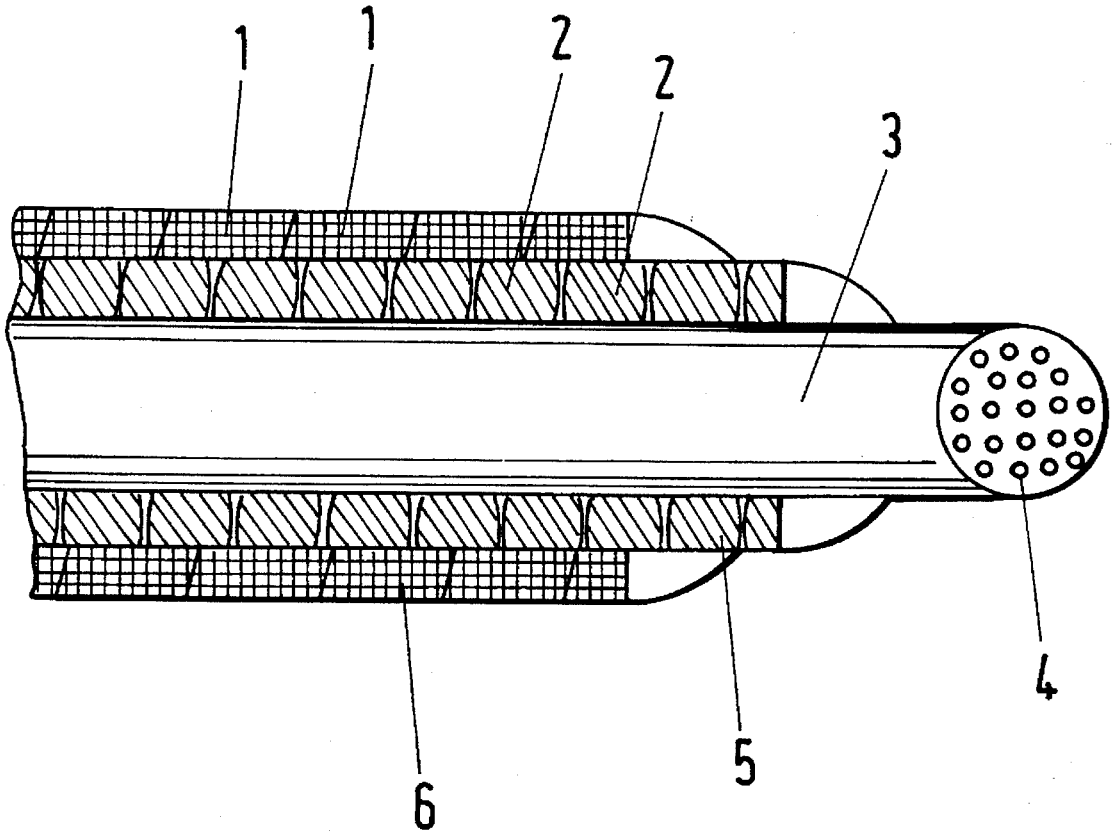
FIG. 1 is a partial cross-sectional view in side elevation of a discant string construction according to the present invention.

Now, turning to the drawings, there is shown in FIG. 1 a discant string having a core 3 consisting of a single group of unwrapped or untwisted around each other synthetic nylon-type filaments 4, a metal covering layer 2 around core 3 consisting of metal wire 5, and an upper covering layer 1 consisting of thin plastic wire 6.

Core 3 of polyfilaments or a single group of continuous synthetic nylon-type filaments 4 which are untwisted with respect to each other is covered by a metal layer 2 formed by a metal wire 5 of 0.05 to 0.07 mm thickness of copper, zinc, brass or bronze. Metal wire 5 is formed in tight contact coils and may be flat in cross section, see FIGS. 2, 5, and 8, rounded in cross section, see FIGS. 3, 6 and 9, or a modified cross section, see FIGS. 4, 7 and 10.

Figure 2:
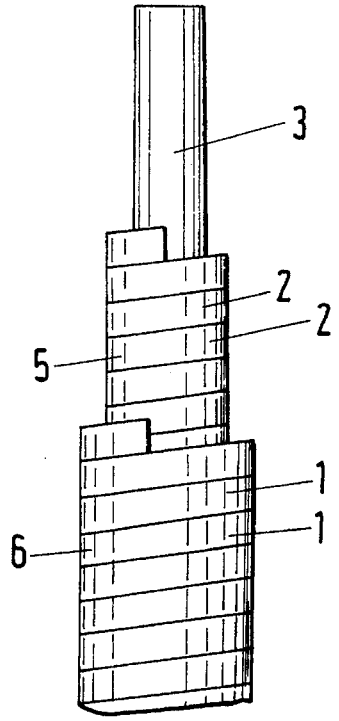
FIG. 2 is partially broken away side elevational view of a first embodiment of a discant string according to the present invention.
Figure 3:
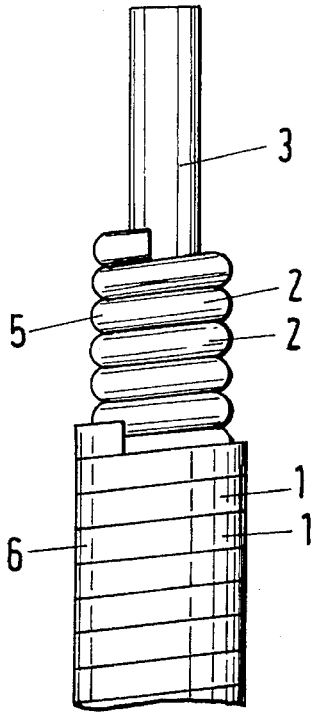
FIG. 3 is a partially broken away side elevational view of a second embodiment of a discant string according to the present invention.
Figure 4:
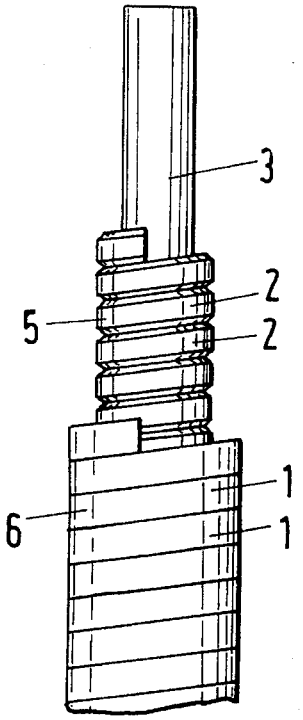
FIG. 4 is a partially broken away side elevational view of a third embodiment of a discant string according to the present invention.
Figure 5:
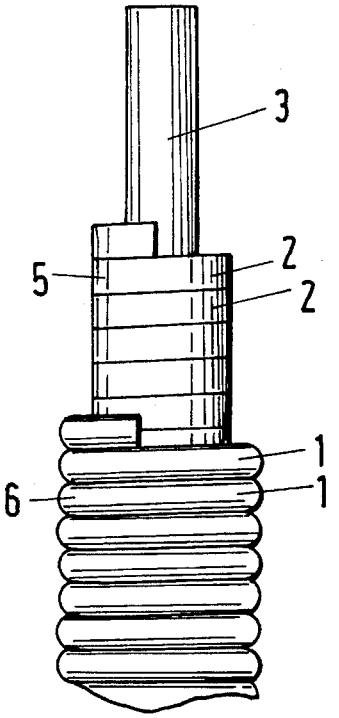
FIG. 5 is a partially broken away side elevational view of a fourth embodiment of a discant string according to the present invention.
Figure 6:
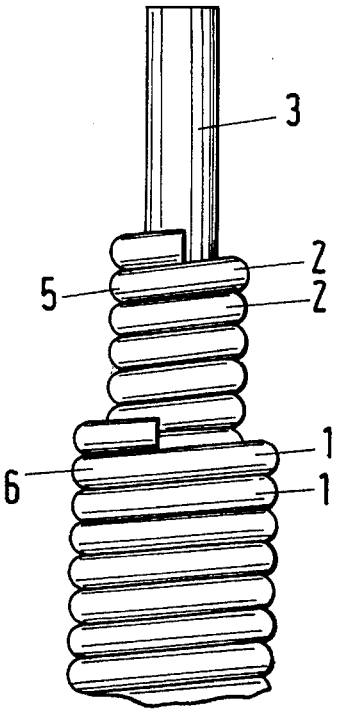
FIG. 6 is a partially broken away side elevational view of a fifth embodiment of a discant string according to the present invention.
Figure 7:
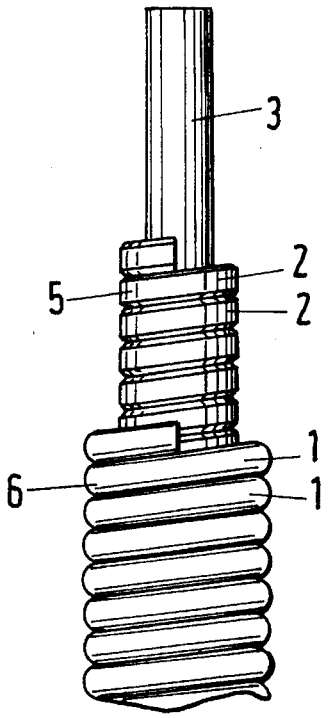
FIG. 7 is a partially broken away side elevational view of a sixth embodiment of a discant string according to the present invention.
Figure 8:
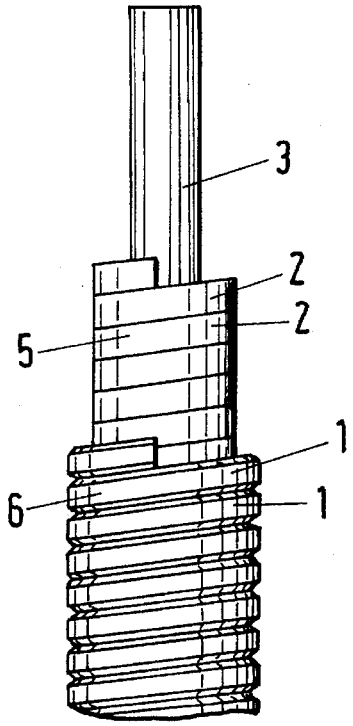
FIG. 8 is a partially broken away side elevational view of a seventh embodiment of a discant string according to the present invention.
Figure 9:
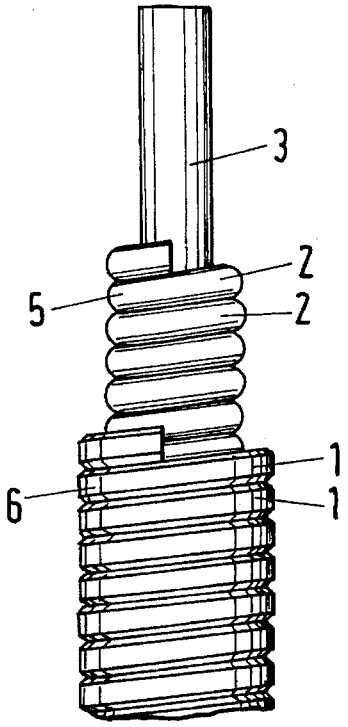
FIG. 9 is a partially broken away side elevational view of an eighth embodiment of a discant string according to the present invention.
Figure 10:
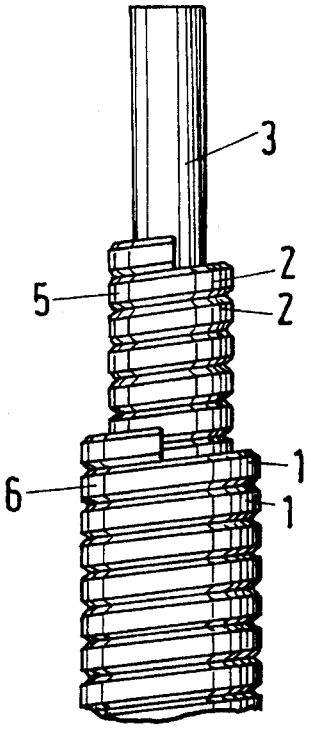
FIG. 10 is a partially broken away side elevational view of a ninth embodiment of a discant string according to the present invention.

Plastic layer 1 may consist of thin plastic wire 6 coiled about metal layer 2 having a thickness of 0.05 to 0.07 mm and a flat cross-sectional shape, see FIGS. 2, 3 and 4, a rounded cross-sectional shape, see FIGS. 5, 6 and 7, and a modified cross-sectional shape, see FIGS. 8, 9 and 10.

Figure 11:
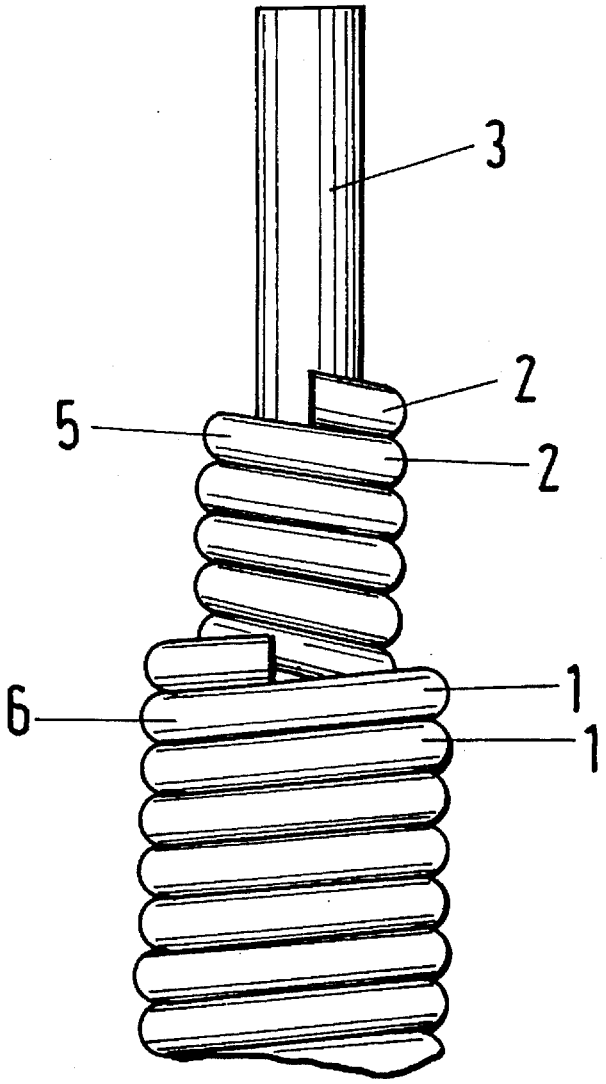
FIG. 11 is a partially broken away side elevational view of a tenth embodiment of a discant string according to the present invention.

Metal wire 5 and plastic wire 6 can be wound from one or opposite directions. As seen in FIG. 11, metal wire 5 is wound in one direction while plastic wire 6 is wound in the opposite direction.

We claim:

1. A discant string for classic and flamenco guitars, comprising:

a) a polyfilament core formed of a single group of non-twisted with respect to each other continuous synthetic nylon-type filaments;

b) a first layer of metal wire spirally wound in tight contact around and covering said polyfilament core, said metal wire being formed from the group consisting of copper, zinc, brass and bronze; and c) a second layer of plastic wire spirally wound around and covering said first layer of metal wire.

2. The discant string as defined in claim 1, wherein said second layer of plastic wire has a thickness of from 0.05 to 0.07 mm.

3. The discant string as defined in claim 1, wherein said first layer of metal wire has a thickness of from 0.05 to 0.07 mm.

4. The discant string as defined in claim 1, wherein said first and second layers are wound in the same direction.

5. The discant string as defined in claim 1, wherein said first and second layers are wound in opposite directions.

6. The discant string as defined in claim 1, wherein the metal wire of said first layer is flat in cross section.

7. The discant string as defined in claim 1, wherein the metal wire of said first layer is rounded in cross section.

8. The discant string as defined in claim 1, wherein the plastic wire of said second layer is flat in cross section.

9. The discant string as defined in claim 1, wherein the plastic wire of said second layer is rounded in cross section.

* * * * *